US005950793A

United States Patent [19]

Schwarzli

[11] Patent Number: 5,950,793

[45] Date of Patent: Sep. 14, 1999

[54] COIN MECHANISM WITH IMPROVED COIN CONVEYOR

[76] Inventor: Josef W. Schwarzli, 3927 Vandorf Road, Stouffville, Ontario, Canada, L4A 7X5

[21] Appl. No.: 08/990,194

[22] Filed: Dec. 12, 1997

[51] Int. Cl.[6] ..... G07F 5/02

[52] U.S. Cl. ..... 194/236; 194/237; 194/255; 194/292

[58] Field of Search ..... 194/236, 237, 194/255, 292

[56] References Cited

U.S. PATENT DOCUMENTS

| | | | |
|---|---|---|---|
| 1,145,458 | 7/1915 | Antoine et al. | 194/292 |
| 1,626,143 | 4/1927 | Mettler | 194/292 |
| 3,937,314 | 2/1976 | Rosenberg et al. | 194/255 |
| 5,111,928 | 5/1992 | Kovens | 194/292 |
| 5,383,545 | 1/1995 | Schwarzli . | |

*Primary Examiner*—Christopher P. Ellis
*Assistant Examiner*—Bryan Jaketic
*Attorney, Agent, or Firm*—Dimock Stratton Clarizio; Mark B. Eisen

[57] ABSTRACT

A coin mechanism includes a coin conveyor provided with a hub on its front face, which rotates in a recess formed in the rear face of the cover plate. The hub reinforces the structural integrity of the coin conveyor, allowing the mechanism to accommodate large coins without diminishing the reliability of the rotational locking mechanism. Preferably the recess is dimensioned as a bearing for the frontal hub, which secures the coin conveyor against shifting due to wearing of parts so that the mechanism retains a high tolerance for measuring the diameter of the coin over a longer period of time.

18 Claims, 6 Drawing Sheets

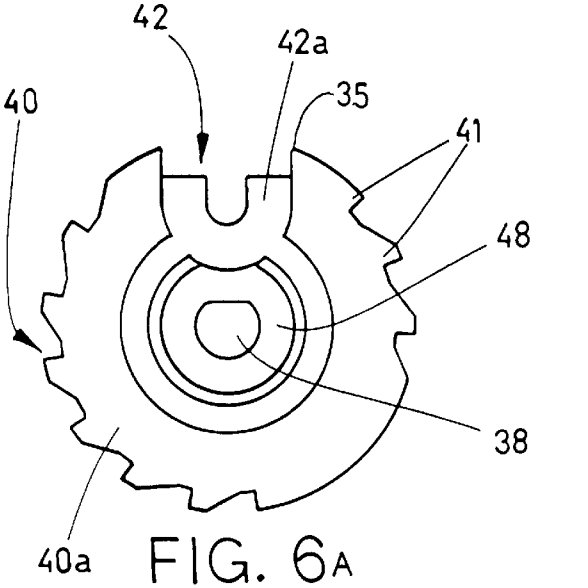
FIG. 6A
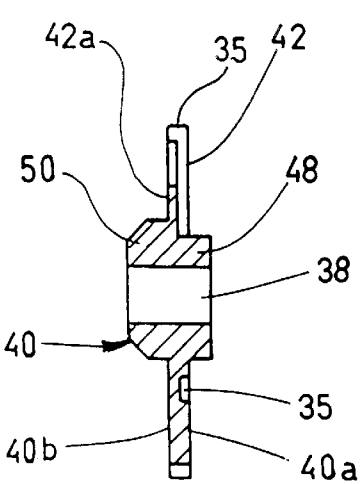
FIG. 7A
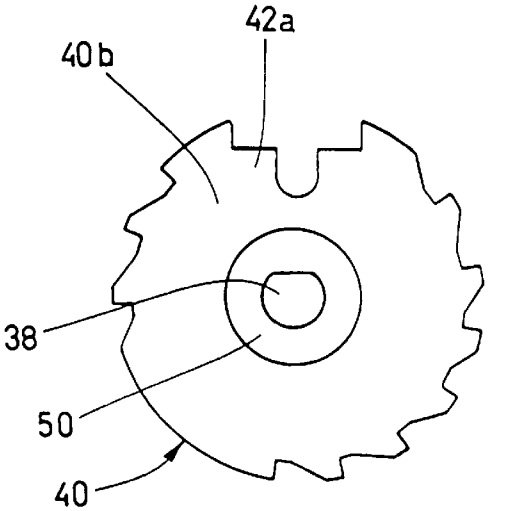
FIG. 8A
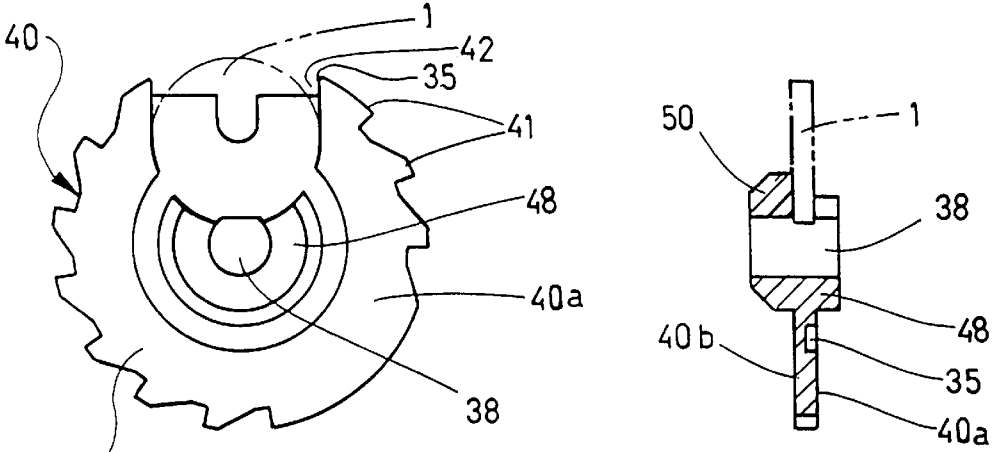
FIG. 6B
FIG. 7B
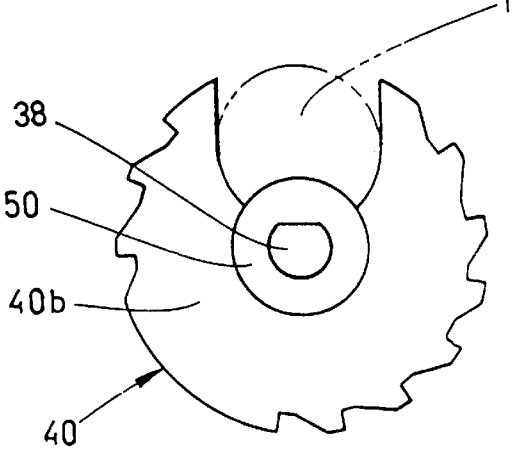
FIG. 8B

COIN MECHANISM WITH IMPROVED COIN CONVEYOR

FIELD OF INVENTION

This invention relates to coin mechanisms for vending machines. In particular, this invention relates to a coin mechanism for a bulk vender or other coin operated apparatus, having an improved coin conveyor.

BACKGROUND OF THE INVENTION

Rotary coin mechanisms are widely used in merchandise-dispensing machines such as bulk venders for dispensing gum balls and other small articles. Such a vender accepts a coin of the intended denomination and as the handle is turned dispenses a preset volume of merchandise to the user. The handle is rotationally fixed to a rotating coin conveyor, which includes a coin recess in which the coin is conveyed about the rotational cycle of the mechanism. Upon rotation of the handle the coin recess rotates past one or more measuring devices that arrest rotation unless the coin is of the required size. If the coin is of the proper size, rotation continues past a dispensing position, the coin is released into a concealed coin tray and the coin conveyor returns to its rest position as the merchandise is dispensed. Such coin mechanisms are well known to those skilled in the art.

Bulk venders and other like apparatus provide a predetermined amount of space for the coin mechanism, and coin mechanisms are thus typically designed to fit all of the necessary parts into the smallest possible space. With the increasing variety of merchandise that such venders are capable of dispensing, and with cost increases due to inflation, it is frequently necessary to design the coin mechanism to accommodate a larger size of coin. In some currencies all coins within the desired nominal range are quite large. However, to accommodate a larger coin without changing the size of the coin mechanism it is necessary to enlarge the coin recess toward the axis of the coin conveyor, ie. toward the shaft of the handle. This considerably reduces the structural integrity of the coin conveyor, because the coin recess occupies most of the thickness of the coin conveyor leaving only a thin web of material to retain a coin in the coin recess. As the coin recess is enlarged toward the axis of the coin conveyor the amount of material surrounding the shaft in the region of the coin recess is commensurately reduced, ultimately to the point where the coin conveyor can no longer be reliably rotationally engaged to the shaft because a relatively small amount of torque becomes sufficient to split the coin conveyor hub. This is a significant problem, because the coin conveyor is the sole part of the mechanism which prevents the handle from being rotated, and thus merchandise from being freely dispensed, unless the correct coin is deposited into the vender.

A further problem arises through the continued use and abuse of coin mechanisms, due to the way the coin conveyor is conventionally mounted. Bulk venders are designed for self service by users, and as such are frequently placed in locations where their use cannot be readily supervised. As a result bulk venders are constantly subjected to attempts to steal merchandise. This frequently involves the use of slugs, or coins from other currencies with lower monetary value, and thus coin mechanisms have evolved with measuring devices that operate to high tolerances, to detect and reject coins or slugs varying in size from a coin of the intended denomination. Coin mechanisms can also be subjected to traumatic impacts in attempts to break the rotational lock and steal merchandise (known as "milking" the vender), which over time loosens the fit between the coin conveyor and the shaft, allowing the coin conveyor to shift radially relative to the shaft.

When the tolerance between the coin conveyor and the handle shaft is reduced due to wear and abuse, so that the coin conveyor can shift radially relative to the shaft, the effectiveness of the diameter measuring device is reduced because a coin will not necessarily follow a consistent rotational path about the mechanism. Even a slight eccentric misalignment of the coin conveyor on the shaft can cause the mechanism to malfunction, resulting in losses to the operator.

SUMMARY OF THE INVENTION

The present invention overcomes these problems by providing a coin conveyor having a frontal hub which seats in a recess provided in the rear face of the cover plate. The frontal hub reinforces the structural integrity of the coin conveyor, allowing the mechanism to accommodate large coins because the coin recess, which is located in the rear face of the coin conveyor, can extend fully to (and even into) the shaft without causing any structural deficiency in the coin conveyor. In the preferred embodiment the recess is dimensioned as a bearing for the frontal hub, so that the frontal hub also acts as a shaft rotating within the bearing formed in the cover plate. This secures the coin conveyor against radial shifting due to wearing of parts so that the mechanism retains the ability to measure coins with a high degree of precision over a significantly longer period of time.

The present invention thus provides a coin mechanism comprising a handle fixed to a shaft extending through an opening in a stationary cover plate and rotatable relative to the cover plate, a rear face of the cover plate having a recess in alignment with the opening, a coin conveyor comprising a coin receiving portion, rotationally engaged to the shaft such that the coin receiving portion is in substantial alignment with the coin opening when the coin conveyor is in a rest position, the coin conveyor having a frontal hub extending into and rotatable within the recess in the cover plate, and a measuring device mounted in stationary relation to the cover plate, wherein when a coin is deposited into the coin receiving portion the coin travels along a rotational path as the handle is turned and is measured by the measuring device which cooperates with the coin conveyor to arrest rotation of the coin conveyor if the deposited coin is not of the proper diameter.

The present invention further provides a coin mechanism comprising a handle fixed to a shaft extending through an axial opening in a stationary cover plate and rotatable relative to the cover plate, the cover plate having a coin opening and a rear face of the cover plate having a recess in concentric alignment with the axial opening, a coin conveyor comprising a coin receiving portion, rotationally engaged to the shaft such that the coin receiving portion is in substantial alignment with the coin opening when the coin conveyor is in a rest position, the coin conveyor having a rear hub and a frontal hub extending into the recess in the cover plate, and a measuring device mounted in stationary relation to the cover plate, the coin receiving portion comprising a coin recess extending from a periphery of the coin conveyor into at least a portion of the rear hub, whereby the frontal hub reinforces the coin conveyor so that the coin conveyor remains rotationally engaged to the shaft during the application of torque to the handle, wherein when a coin is deposited into the coin receiving portion the coin travels along a rotational path as the handle is turned and is measured by the diameter measuring device which cooperates with the coin conveyor to arrest rotation of the coin conveyor if the deposited coin is not of the proper diameter.

The present invention further provides an apparatus for dispensing merchandise having a coin mechanism comprising a handle fixed to a shaft extending through an axial opening in a stationary cover plate and rotatable relative to the cover plate, the cover plate having a coin opening and a rear face of the cover plate having a recess in concentric alignment with the axial opening, a coin conveyor comprising a coin receiving portion, rotationally engaged to the shaft such that the coin receiving portion is in substantial alignment with the coin opening when the coin conveyor is in a rest position, the coin conveyor having a rear hub and a frontal hub extending into the recess in the cover plate, and a measuring device mounted in stationary relation to the cover plate, the coin receiving portion comprising a coin recess extending from a periphery of the coin conveyor into at least a portion of the rear hub, whereby the frontal hub reinforces the coin conveyor so that the coin conveyor remains rotationally engaged to the shaft during the application of torque to the handle, wherein when a coin is deposited into the coin receiving portion the coin travels along a rotational path as the handle is turned and is measured by the diameter measuring device which cooperates with the coin conveyor to arrest rotation of the coin conveyor if the deposited coin is not of the proper diameter.

BRIEF DESCRIPTION OF THE DRAWINGS

In drawings which illustrate by way of example only a preferred embodiment of the invention, FIGS. 6*a* and 6*b* are rear elevations of embodiments of the coin conveyor of the invention designed for small and large coins, respectively, FIGS. 7*a* and 7*b* are cross-sections of the coin conveyors of FIGS. 6*a* and 6*b*, respectively, FIGS. 8*a* and 8*b* are front elevations of the coin conveyors of FIGS. 6*a* and 6*b*, respectively, and FIG. 9 ia an exploded perspective view of the coin mechanism of the invention.

DETAILED DESCRIPTION OF THE INVENTION

Figure 1:
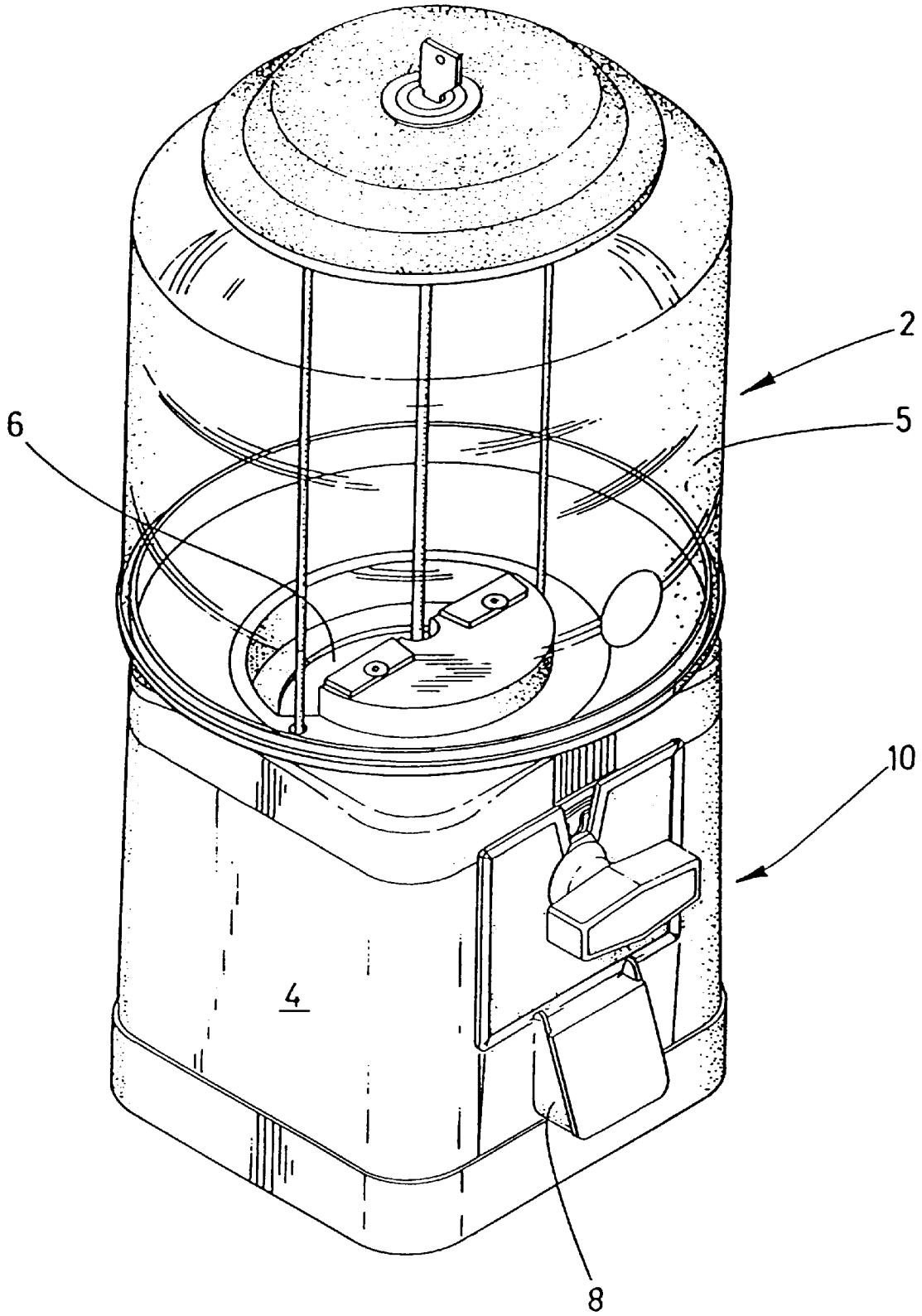
FIG. 1 is a perspective view of a bulk vender embodying the coin mechanism of the invention.

FIG. 1 illustrates a merchandise-dispensing apparatus commonly known as a bulk vender 2 in which the coin mechanism 10 of the invention may be employed. The vender 2 conventionally includes a lower housing 4 enclosing the workings of the coin mechanism and a cash box (not shown) for collecting deposited coins or tokens 1, a transparent article storage bin 5 for storing merchandise such as gum balls or other articles to be dispensed, and a turntable 6 which is rotated by rotation of the coin mechanism 10 to align one of a plurality of product conveyors with the opening to a dispensing chute 8, as is well known.

Although the invention will be described with reference to a coin, the term "coin" as used herein includes coins and tokens and like elements and is in no way restricted to currency or coins having a monetary value. It will also be understood that the coin mechanism of the invention may be used in other types of apparatus which do not necessarily dispense merchandise, for example parking meters, and the invention is not restricted to any particular application of the coin mechanism 10.

FIGS. 2 to 8 illustrate a preferred embodiment of the coin mechanism 10 of the invention. The mechanism 10 comprises a cover plate 20 having a coin opening 24. A handle 30 is fixed to a tapered shaft 32 which extends through an opening formed by a nipple 26 projecting from the cover plate 20 and engages an opening 38 disposed through the center of a substantially disc-shaped coin conveyor 40. The shaft 32 has a longitudinal flat (or slightly concave) surface 32*a* allowing it to rotationally engage the coin conveyor 40.

The coin conveyor 40 includes a coin receiving portion for receiving a coin 1 which comprises a recess 42 formed to the size of the intended coin 1, in which the coin 1 nests as it is conveyed about the rotational cycle of the coin mechanism 10. In the preferred embodiment the coin recess 42 does not extend through the entire thickness of the coin conveyor 40, such that a web 42*a* forms a backing to the coin recess 42 which retains the coin 1 flush against the rear face 40*a* of the coin conveyor 40. The coin conveyor 40 is provided with a rear hub 48 which extends about the shaft 32 and rotationally engages the coin conveyor 40 to the shaft 32. In the illustrated embodiment the coin conveyor 40 is provided with peripheral ratchet teeth 41 which cooperate with a pawl to prevent reverse rotation of the mechanism 10 during most of the rotational cycle (a small radius of reverse rotation is permitted immediately beyond the rest position, which allows the coin conveyor 40 to revert to the rest position if the measuring devices reject the deposited coin).

A back plate 80 overlays the coin conveyor 40 and is affixed to the cover plate 20 so as to be stationary relative thereto, as by bolts 81. The back plate 80 retains a coin 1 in the coin recess 42 along the rotational path followed by the coin 1 as the handle 30 is rotated. The shaft 32 extends through an opening 86 in the back plate 80 and is rotationally engaged to a dispensing gear 64 for rotating the turntable 6. Thus, the cover plate 20 and back plate 80 remain stationary, while the coin conveyor 40 and gear 64 are fixed in position on the shaft 32 and rotate as the handle 30 is turned. In the embodiment shown the opening 86 in the back plate is larger than the rear hub 48, so that the hub 48 projects through the opening 86 and rotates freely therein. A dog 70 for measuring the thickness of a coin 1 may be mounted on the back plate 80 biased against the coin recess 42 by a spring 70*a*, to catch the trailing edge of the coin recess 42 if a deposited coin or slug is thinner than the intended coin 1 and arrest rotation of the mechanism 10.

A coin or slug that is larger than the intended coin 1 cannot be deposited into the coin recess 42, which is dimensioned a closely as possible to match the diameter of the intended coin 1. Conventionally a diameter measuring dog 34 for measuring the diameter of the coin 1 is pivotally mounted on the cover plate 20, biased against the coin conveyor 40 by a spring 34*a*, to catch on the trailing corner 35 of the coin recess 42 if a deposited coin or slug has a diameter smaller than the intended coin 1 and thus arrest rotation of the mechanism 10. The coin conveyor 40 thus conveys the proper coin 1 to the coin ejection ramp 25, where it falls into a coin tray (not shown) concealed within the vender housing 4, along a specific rotational path that allows the measuring dog 34 to measure the coin 1 at the designated radial position. If a deposited coin or slug is not of the correct size, the dog 34 cooperates with the coin conveyor 40 to arrest rotation of the mechanism 10.

The diameter measuring dog 34 is pivotally mounted at a fixed position on the cover plate 20, and precisely measures the diameter of the coin 1 from this fixed position. The coin 1 must therefore be in exactly the intended radial position when measured by the dog 34. More specifically, the outermost point of the coin 1 (which is the uppermost point of the coin 1 when the coin conveyor is in the rest position shown in FIGS. 2 and 3) must pass the diameter measuring dog 34 at a specific radial position relative to the cover plate 20. If the outermost point of the coin 1 is too close to the axis of the mechanism 10, the dog 34 will treat the coin 1 as undersized and arrest rotation of the mechanism 10. This requirement limits the design of such a coin mechanism in two ways.

First, since the outermost point of the coin 1 must pass the diameter measuring dog 34 at the designated radial position, increasing the size of the coin 1 which the mechanism 10 can accommodate requires either enlarging the entire coin mechanism 10, so that the diameter measuring dog 34 can be positioned further from the axis of the mechanism 10, or enlarging the coin recess 42 toward the center of the coin conveyor 40. Enlarging the size of the mechanism 10 is costly and impractical, and presents problems in terms of retrofitting a mechanism adapted for new coin size into existing venders 2. However, enlarging the coin recess 42 toward the center of the coin conveyor 40 has limitations in a conventional mechanism 10. As the coin recess 42 approaches the shaft 32 the coin conveyor is significantly weakened because the web 42*a* is not structurally secure, so even a small amount of torque on the handle 30 can split the coin conveyor 40 and eliminate its rotational engagement to the shaft 32. Since the coin conveyor 40 provides the sole means of arresting rotation of the mechanism 10 unless the proper coin 1 has been deposited into the coin mechanism 10, the vender 2 could then be emptied of merchandise without any monetary compensation to the operator.

Second, the coin conveyor 40 cannot be permitted to shift relative to the shaft 32, ie. the axis of the coin conveyor 40 must remain fixed in line with the axis of rotation of the mechanism 10. If the coin conveyor 40 shifts radially even slightly, the reliability of the mechanism 10 is significantly reduced because there can be no guarantee that the outermost point of the edge of the coin 1 will pass the diameter measuring dog 34 at the required radial position. Conventionally this has been achieved by designing the coin conveyor 40 to fit very snugly on the shaft 32, and relying entirely on the alignment of the shaft 32 to constrain the coin conveyor 40 against radial shifting. However, over time the fit between the coin conveyor 40 and the shaft 32 tends to loosen through wear, and especially if the handle 30 is subjected to impacts or other abuse, vandalism or attempted theft, the tolerance between the coin conveyor 40 and the shaft 32 can diminish to the point that shifting of the coin conveyor 40 becomes a significant problem.

The present invention provides a means for permitting the coin recess 42 to be enlarged to accept a large diameter coin 1, while at the same time fixing the coin conveyor 40 radially relative to the cover plate 20.

Figure 4:
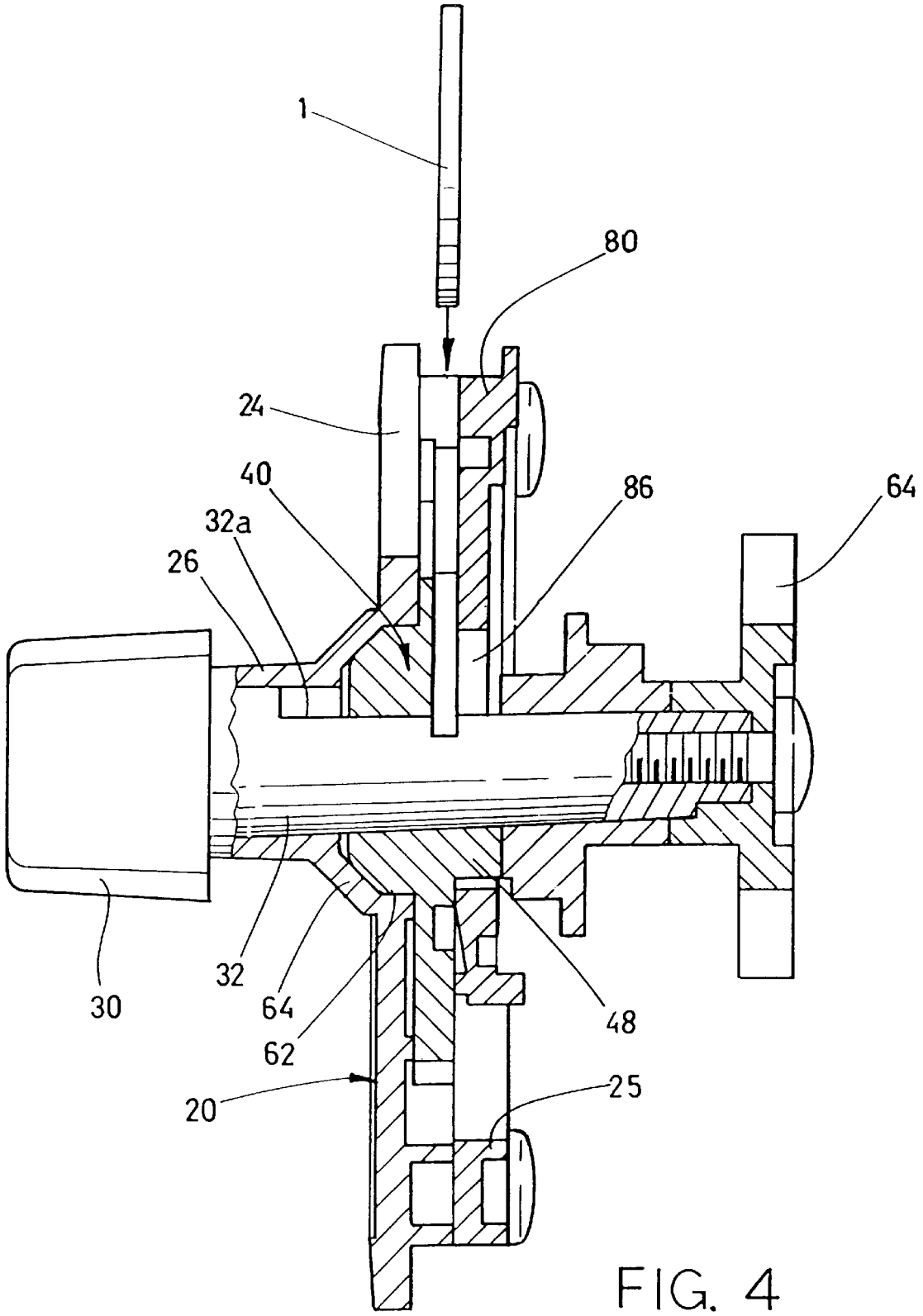
FIG. 4 is a cross-section of the coin mechanism of FIG. 2.
Figure 5:
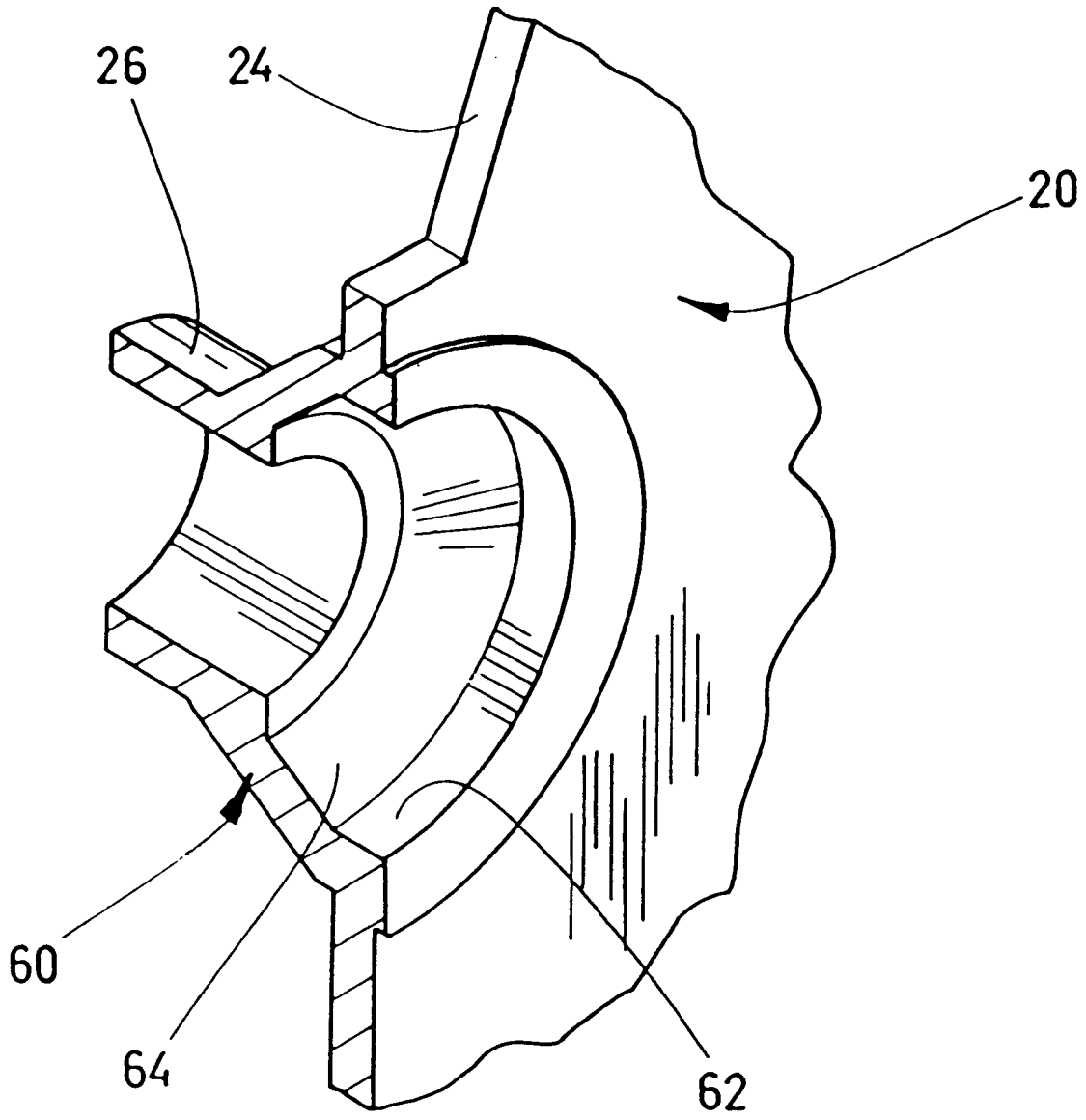
FIG. 5 is a partial cross-sectional perspective view of a cover plate for the coin mechanism of the invention.
Figure 9:
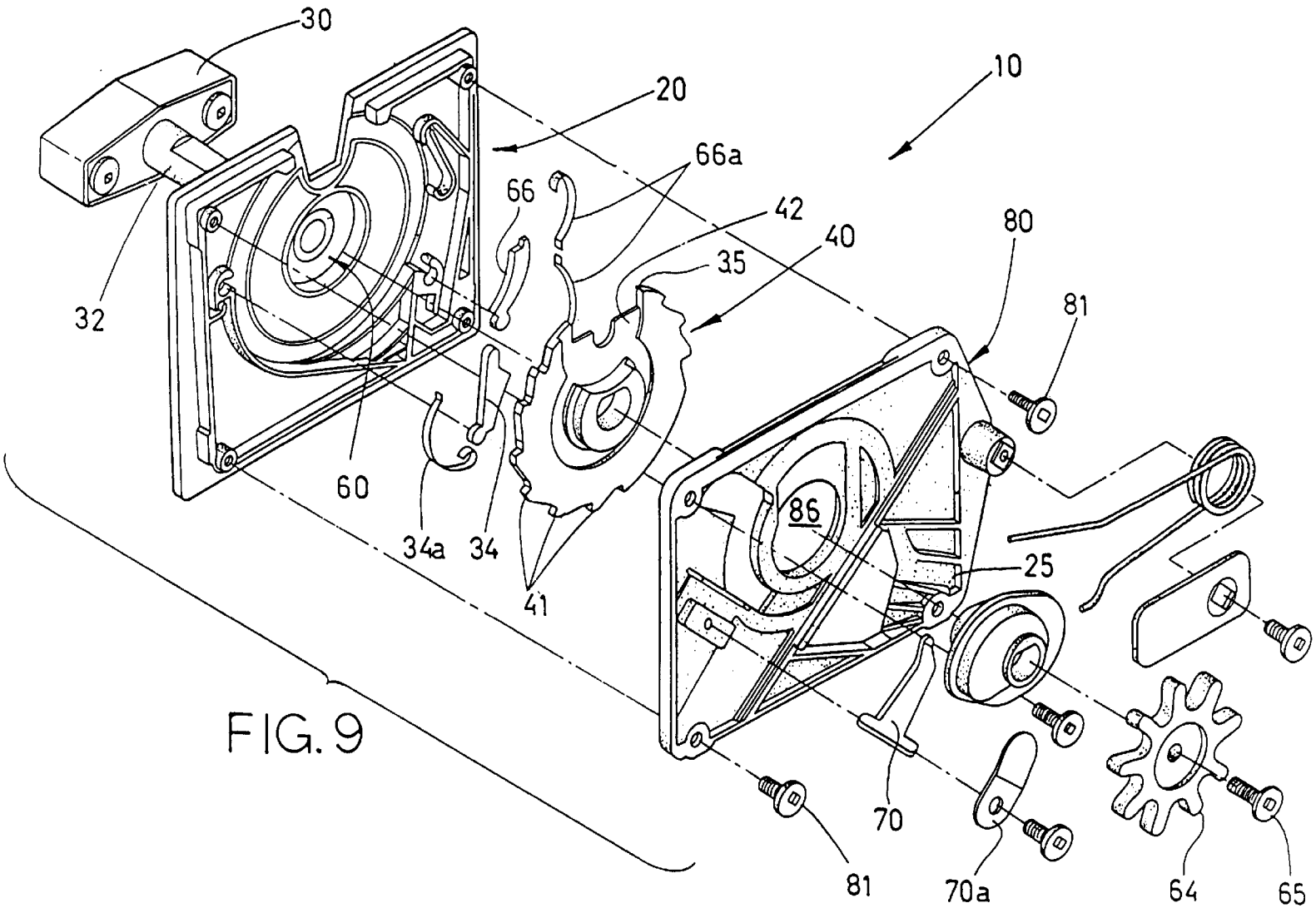

According to the invention the coin conveyor 40 is provided with a cylindrical frontal hub 50, shown in FIGS. 4 to 8, which projects into a recess 60 in the rear face of the cover plate 20 concentric with the opening through the nipple 26, as shown in FIGS. 4 and 5. The hub 50 serves to reinforce the coin conveyor 40 in the region about the shaft 32. This allows the coin recess 42 to be enlarged toward the center of the coin conveyor 40, without reducing the structural integrity of the coin conveyor 40.

FIGS. 6*a*, 7*a* and 8*a* illustrate by way of example a coin carrier 40 of the invention designed for a small coin, such as a 10¢ coin, and thus having a coin recess 42 which extends into the periphery of the rear hub 48. In this embodiment the frontal hub 50 provides reinforcement for the rear hub 48, which both strengthens the region of the coin conveyor 40 surrounding the shaft 32 and lengthens the area of contact between the coin conveyor 40 and the shaft 32, which helps to preserve a tight fit therebetween.

FIGS. 6*b*, 7*b* and 8*b* illustrate a coin carrier 40 of the invention designed for a large coin, such as a $1.00 coin, and thus having a coin recess 42 which extends completely through the rear hub 48 and into the opening 34 (which in the assembled mechanism 10 is occupied by the shaft 32). In this embodiment the frontal hub 50 assures that the coin conveyor 40 remains rotationally engaged to the shaft 32. The provision of the frontal hub 50 thus allows the portion of the rear hub 48 in the region of the coin recess 42 to be eliminated entirely. This in turn allows the coin recess 42 to extend completely through the hub 48, and even into the opening 38, without sacrificing the structural integrity of the coin conveyor 40. Moreover, the web 42*a* can be eliminated, as shown the embodiment of FIGS. 6*b* to 8*b*, since the frontal hub 50 will also serve to maintain the coin 1 flush with the rear face 40*a* of the coin conveyor 40. The coin 1 can thus occupy the entire thickness of the coin conveyor 40, again without any reduction in structural integrity, which allows the coin conveyor 42 to be made as thin as the coin 1 and thus conserves space within the coin mechanism 10.

In the embodiment shown in FIGS. 6*b*, 7*b* and 8*b* the shaft 32 is notched as at 32*a* so that the coin 1 can impinge into the shaft 32, allowing the mechanism 10 to accommodate even very large coins 1. It will be apparent to those skilled in the art that the shaft 32 must remain thick enough at the point of the notch 32*a* that manual force cannot crack or deform the shaft 32; it may be desirable in this regard to include a conventional clutch mechanism (not shown) in the coupling between the handle 30 and the shaft 32 which disengages the rotational lock therebetween before a torque sufficient to crack or deform the shaft 32 is reached.

In the preferred embodiment the recess 60 acts as a bearing for the frontal hub 50. In the embodiment shown the recess 60 comprises a proximal portion 62 which is cylindrical and dimensioned so that the hub 50 fits into the proximal portion 62 of the recess 60 with the smallest possible clearance while still allowing the hub 50 to rotate within the recess 60. Rotation of the frontal hub 50 within the recess 60 is facilitated by suitable lubrication, and the recess 60 may thus include a distal portion 61, shown as frusto-conical, which projects forwardly of the cover plate 20 and serves as a reservoir for a lubricant such as a grease-saturated felt ring (not shown). The rotation of the hub 50 within the recess 60 radially fixes the coin conveyor 40 in concentric alignment with the axis of the coin mechanism 10. Thus, wear on the point of engagement between the coin conveyor 40 and the shaft 32 does not affect the stability or alignment of the coin conveyor 40, or the reliability of the diameter measuring device 34.

Figure 2:
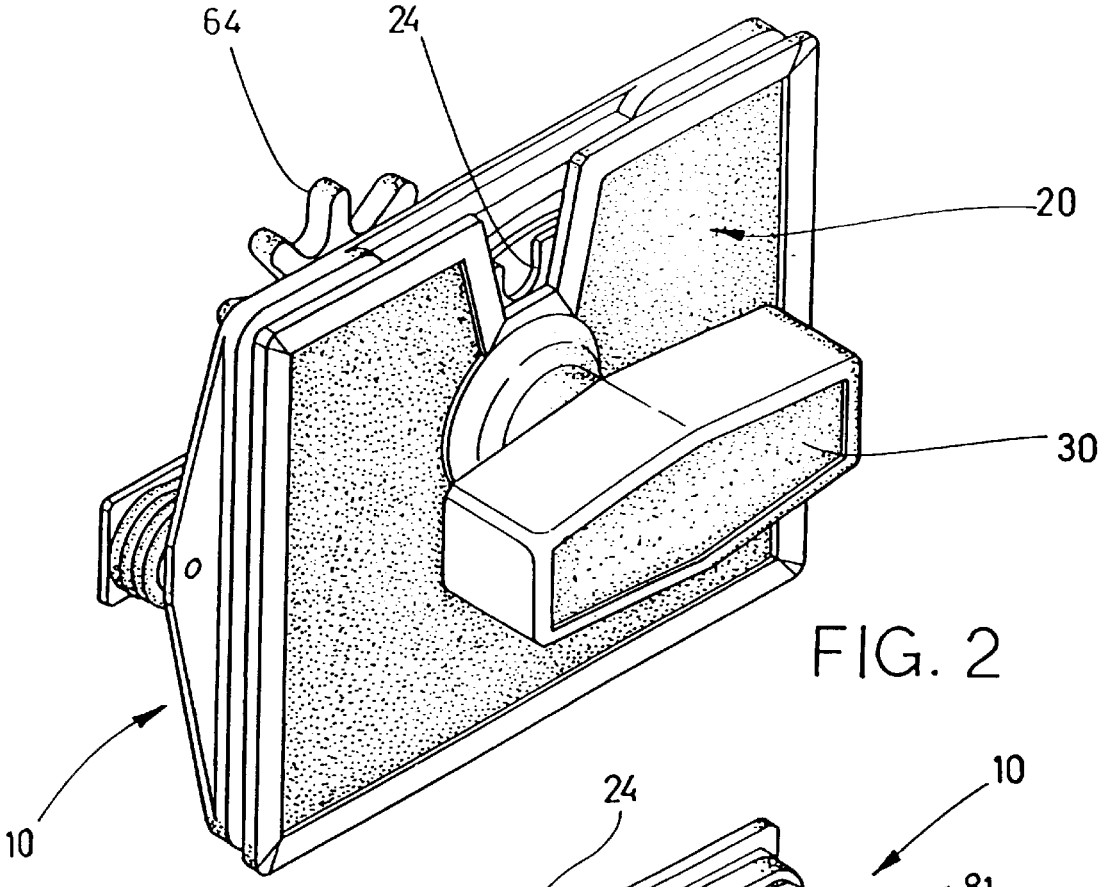
FIG. 2 is a front perspective view of a coin mechanism of the invention.
Figure 3:
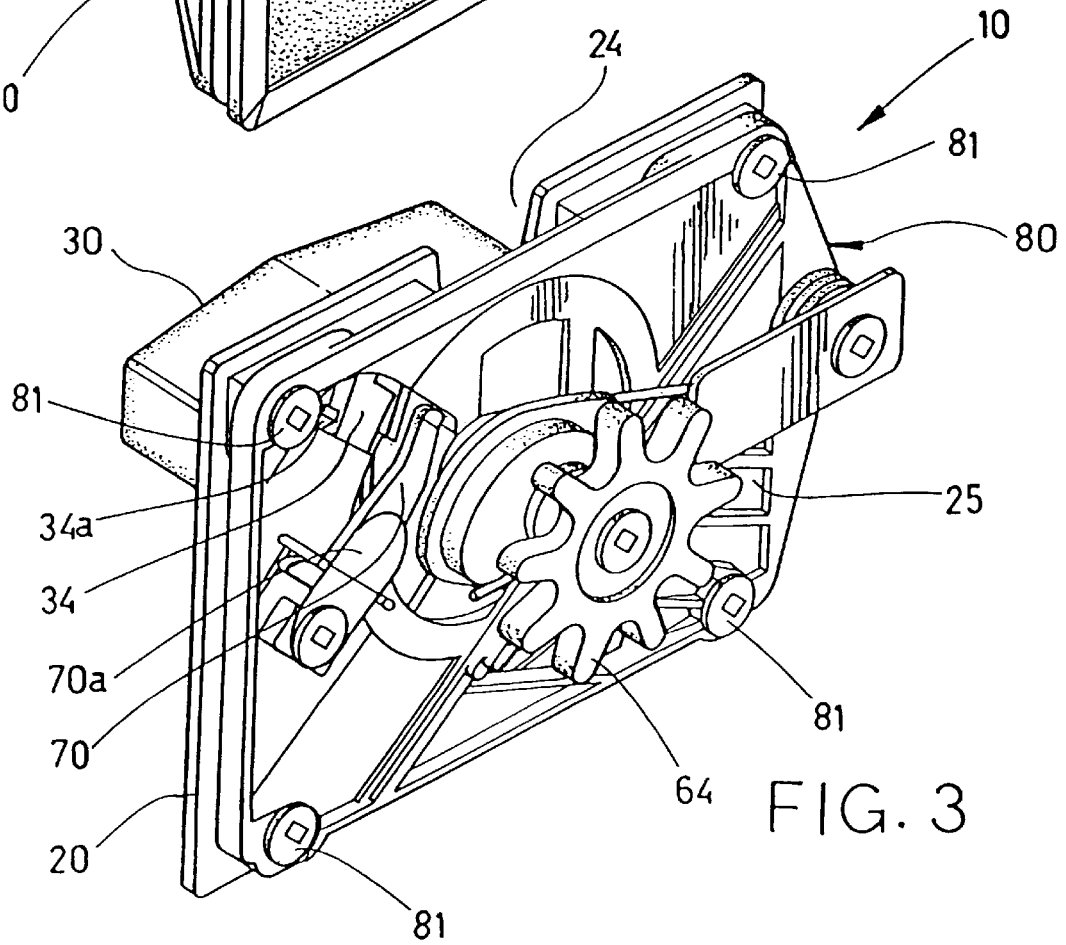
FIG. 3 is a rear perspective view of the coin mechanism of FIG. 2.

In operation the mechanism 10 is normally in the rest position shown in FIG. 2, with the coin recess 42 in alignment with the coin opening 24 in the cover plate 20.

When a coin 1 of the intended denomination is deposited through the coin opening 24, the coin 1 nests in the coin recess 42 of the coin conveyor 40 and is retained in the coin recess 42 by the frontal hub 50 (or optionally a web 42*a*) and the back plate 80. The handle 30 is turned to the point in the rotational cycle where the measuring dog 34 measures the coin 1 to ensure that it is of the correct diameter. If the coin 1 is of the intended denomination, the measuring dog 34 will allow the mechanism 10 to be rotated through the dispensing cycle. In the preferred embodiment the hub 50 rotates as a shaft within the recess 60 and thus maintains the coin conveyor 40 in concentric alignment with the cover plate 20 throughout continued operation of the coin mechanism 10.

The coin 1 is typically released from the mechanism 10 just beyond the halfway point in the rotational cycle of the mechanism 10, at the ejection ramp 25 in the embodiment illustrated. As the handle 30 is turned the gear 64 rotates the turntable 6 so that an opening in the turntable 6 comes into alignment with the dispensing chute 8 and dispenses merchandise to the user as the mechanism 10 returns to the rest position for the next use.

The invention having been thus described with reference to a preferred embodiment, it will be apparent to those skilled in the art that variations and modifications of the invention may be made without departing from the scope of the invention, as set out in the appended claims.

I claim:

1. A coin mechanism comprising a handle fixed to a shaft extending through an opening in a stationary cover plate and rotatable relative to the cover plate, a rear face of the cover plate having a recess in alignment with the opening, a coin conveyor comprising a coin receiving portion, rotationally engaged to the shaft such that the coin receiving portion is in substantial alignment with a coin opening when the coin conveyor is in a rest position, the coin conveyor having a frontal hub extending into and rotatable within the recess in the cover plate, and a measuring device mounted in stationary relation to the cover plate, wherein when a coin is deposited into the coin receiving portion the coin travels along a rotational path as the handle is turned and is measured by the measuring device which cooperates with the coin conveyor to arrest rotation of the coin conveyor if the deposited coin is not of the proper diameter.

2. The mechanism of claim 1 in which the frontal hub is cylindrical and the recess in the cover plate comprises a proximal cylindrical portion in which the frontal hub rotates in concentric alignment with the opening in the cover plate.

3. The mechanism of claim 2 including a distal portion forming a reservoir for a lubricant.

4. The mechanism of claim 3 in which the distal portion is frusto-conical.

5. A coin mechanism comprising a handle fixed to a shaft extending through an axial opening in a stationary cover plate and rotatable relative to the cover plate, the cover plate having a coin opening and a rear face of the cover plate having a recess in concentric alignment with the axial opening, a coin conveyor comprising a coin receiving portion, rotationally engaged to the shaft such that the coin receiving portion is in substantial alignment with the coin opening when the coin conveyor is in a rest position, the coin conveyor having a rear hub and a frontal hub extending into the recess in the cover plate, and a measuring device mounted in stationary relation to the cover plate, the coin receiving portion comprising a coin recess extending from a periphery of the coin conveyor into at least a portion of the rear hub, whereby the frontal hub reinforces the coin conveyor so that the coin conveyor remains rotationally engaged to the shaft during the application of torque to the handle, wherein when a coin is deposited into the coin receiving portion the coin travels along a rotational path as the handle is turned and is measured by the measuring device which cooperates with the coin conveyor to arrest rotation of the coin conveyor if the deposited coin is not of the proper diameter.

6. The mechanism of claim 5 in which the frontal hub acts as a shaft and the recess in the cover plate acts as a bearing to maintain axial alignment between the coin conveyor and the cover plate.

7. The mechanism of claim 5 in which the coin recess extends fully through the rear hub.

8. The mechanism of claim 7 in which the coin recess extends into a notch in the shaft.

9. The mechanism of claim 5 in which the coin conveyor comprises a web in front of the coin recess which retains a coin flush with a rear face of the coin conveyor.

10. The mechanism of claim 5 in which the coin recess extends fully through the thickness of the coin conveyor, whereby a coin is retained flush with a rear face of the coin conveyor by the frontal hub.

11. The mechanism of claim 5 in which the rear hub extends through an opening in a back plate fixed to the cover plate.

12. An apparatus for dispensing merchandise having a coin mechanism comprising a handle fixed to a shaft extending through an axial opening in a stationary cover plate and rotatable relative to the cover plate, the cover plate having a coin opening and a rear face of the cover plate having a recess in concentric alignment with the axial opening, a coin conveyor comprising a coin receiving portion, rotationally engaged to the shaft such that the coin receiving portion is in substantial alignment with the coin opening when the coin conveyor is in a rest position, the coin conveyor having a rear hub and a frontal hub extending into the recess in the cover plate, and a measuring device mounted in stationary relation to the cover plate, the coin receiving portion comprising a coin recess extending from a periphery of the coin conveyor into at least a portion of the rear hub, whereby the frontal hub reinforces the coin conveyor so that the coin conveyor remains rotationally engaged to the shaft during the application of torque to the handle, wherein when a coin is deposited into the coin receiving portion the coin travels along a rotational path as the handle is turned and is measured by the measuring device which cooperates with the coin conveyor to arrest rotation of the coin conveyor if the deposited coin is not of the proper diameter.

13. The apparatus of claim 12 in which the frontal hub acts as a shaft and the recess in the cover plate acts as a bearing to maintain axial alignment between the coin conveyor and the cover plate.

14. The apparatus of claim 12 in which the coin recess extends fully through the rear hub.

15. The apparatus of claim 14 in which the coin recess extends into a notch in the shaft.

16. The apparatus of claim 12 in which the coin conveyor comprises a web in front of the coin recess which retains a coin flush with a rear face of the coin conveyor.

17. The apparatus of claim 12 in which the coin recess extends fully through the thickness of the coin conveyor, whereby a coin is retained flush with a rear face of the coin conveyor by the frontal hub.

18. The apparatus of claim 12 in which the rear hub extends through an opening in a back plate fixed to the cover plate.

* * * * *